US011224792B2

(12) United States Patent
Rhodes et al.

(10) Patent No.: US 11,224,792 B2
(45) Date of Patent: Jan. 18, 2022

(54) ATHLETIC HAND GRIPS

(71) Applicant: Bear KompleX, Crown Point, IN (US)

(72) Inventors: Jacob A. Rhodes, Crown Point, IN (US); Adrian N. Richie, Crown Point, IN (US)

(73) Assignee: Bear KompleX, Crown Point, IN (US)

( * ) Notice: Subject to any disclaimer, the term of this patent is extended or adjusted under 35 U.S.C. 154(b) by 0 days.

(21) Appl. No.: 15/612,489

(22) Filed: Jun. 2, 2017

(65) Prior Publication Data

US 2017/0348584 A1 Dec. 7, 2017

Related U.S. Application Data

(60) Provisional application No. 62/345,646, filed on Jun. 3, 2016.

(51) Int. Cl.
*A63B 71/14* (2006.01)
*A41D 13/05* (2006.01)

(52) U.S. Cl.
CPC ..... *A63B 71/14* (2013.01); *A41D 13/0562* (2013.01); *A41D 13/0568* (2013.01); *A63B 2244/09* (2013.01)

(58) Field of Classification Search
CPC ..... A41D 13/0568; A41D 13/0562; A63B 2244/09; A63B 71/14; A63B 21/4021
USPC ..... 2/16, 20, 21, 161.1, 161.6, 163, 195.1; 473/60, 61; 482/23, 49; D29/117.2
See application file for complete search history.

(56) References Cited

U.S. PATENT DOCUMENTS

| | | | | |
|---|---|---|---|---|
| 1,692,201 | A | 11/1928 | Denman et al. | |
| D174,430 | S | 4/1955 | Horowitz | |
| D235,401 | S | 6/1975 | Tegner et al. | |
| D256,401 | S | 8/1980 | Adams | |
| 4,400,831 | A | 8/1983 | Rietz | |
| D275,219 | S | 8/1984 | Scales, Jr. | |
| D275,695 | S | 9/1984 | Brown | |
| D276,062 | S | 10/1984 | Dennis | |
| 4,632,103 | A | 12/1986 | Fabricant et al. | |
| D295,897 | S | 5/1988 | Thimm-Kelly | |
| D340,990 | S | 11/1993 | Kawamura et al. | |
| 5,298,001 | A * | 3/1994 | Goodson | A63B 21/4021 2/161.1 |
| 5,350,343 | A | 9/1994 | Dasilva | |
| 5,353,440 | A * | 10/1994 | Meldeau | A41D 19/01547 2/161.1 |

(Continued)

FOREIGN PATENT DOCUMENTS

ES 0523093 S 4/2016

OTHER PUBLICATIONS

See attached evidence of indexed www.bearkompleX.com webpage on or after Sep. 26, 2015 referencing instagram post of May 30, 2015. (Year: 2015).*

(Continued)

*Primary Examiner* — Katherine M Moran
(74) *Attorney, Agent, or Firm* — Faegre Drinker Biddle & Reath LLP

(57) ABSTRACT

The present disclosure provides athletic hand grips and methods of using the same. The hand grips may be provided in pairs and worn on both hands to protect the user's palms, in particular. The hand grips may be worn during various athletic activities, including weight lifting, CrossFit activities, and gymnastics, for example.

17 Claims, 18 Drawing Sheets

(56) References Cited

U.S. PATENT DOCUMENTS

| | | | | |
|---|---|---|---|---|
| 5,479,660 | A | 1/1996 | Najac | |
| 5,745,920 | A | 5/1998 | Olivier | |
| 5,809,570 | A | 9/1998 | Grover | |
| 5,813,950 | A * | 9/1998 | Parker | A41D 13/082 2/20 |
| 5,898,944 | A | 5/1999 | Vrany | |
| D425,394 | S | 5/2000 | Brady | |
| D449,136 | S | 10/2001 | Vallance | |
| D459,772 | S | 7/2002 | Meldeau | |
| D463,566 | S | 9/2002 | Slautterback | |
| D464,686 | S | 10/2002 | Silveira et al. | |
| D478,195 | S | 8/2003 | McGinty | |
| 6,666,795 | B2 * | 12/2003 | Mah | A63B 21/4019 2/161.1 |
| D496,706 | S | 9/2004 | Auberger | |
| D497,679 | S | 10/2004 | Soika | |
| 6,834,397 | B1 | 12/2004 | Murphy | |
| D502,231 | S | 2/2005 | Auberger | |
| 6,849,036 | B2 | 2/2005 | Forslid | |
| D502,573 | S | 3/2005 | Jones | |
| D508,097 | S | 8/2005 | Perez | |
| D513,297 | S | 12/2005 | Bourget | |
| 7,008,355 | B2 | 3/2006 | Emick | |
| D520,366 | S | 5/2006 | Fonnesbeck | |
| 7,043,762 | B2 | 5/2006 | Greenhalgh | |
| D647,778 | S | 11/2011 | Gallik | |
| D706,890 | S | 6/2014 | Scheffer | |
| D706,891 | S | 6/2014 | Scheffer | |
| 8,747,284 | B2 | 6/2014 | Ingram | |
| D710,955 | S | 8/2014 | Boruch | |
| D728,039 | S | 4/2015 | Groshek | |
| D734,407 | S | 7/2015 | Gangemi | |
| D741,974 | S | 10/2015 | Lung | |
| D751,771 | S | 3/2016 | Hunter et al. | |
| D752,695 | S | 3/2016 | Boruch | |
| 9,380,817 | B1 | 7/2016 | Drake | |
| D763,516 | S | 8/2016 | Robbins | |
| D769,538 | S * | 10/2016 | Gutman | D29/113 |
| D770,690 | S | 11/2016 | Robbins | |
| 9,643,073 | B1 * | 5/2017 | Pellegrino | A63B 71/141 |
| D804,589 | S | 12/2017 | Boruch | |
| D806,956 | S | 1/2018 | Hunter et al. | |
| D815,699 | S | 4/2018 | Koven | |
| D824,112 | S | 7/2018 | Picon | |
| D855,719 | S | 8/2019 | Rhodes et al. | |
| 10,383,380 | B2 | 8/2019 | Koven | |
| D860,340 | S | 9/2019 | Jones | |
| D863,464 | S | 10/2019 | Rhodes et al. | |
| D868,387 | S * | 11/2019 | Picon | D29/117.2 |
| 10,486,011 | B2 | 11/2019 | McGuire et al. | |
| D869,094 | S * | 12/2019 | Picon | D29/117.2 |
| D869,095 | S * | 12/2019 | Picon | D29/117.2 |
| 10,576,356 | B1 * | 3/2020 | Pellegrino | A63B 71/14 |
| 10,702,761 | B2 * | 7/2020 | Pellegrino | A63B 71/14 |
| 2003/0130096 | A1 | 7/2003 | LaCroce | |
| 2003/0199364 | A1 | 10/2003 | Mah | |
| 2005/0081273 | A1 | 4/2005 | Ota | |
| 2006/0084557 | A1 | 4/2006 | Kassel et al. | |
| 2008/0008597 | A1 | 1/2008 | Dannemiller et al. | |
| 2008/0120755 | A1 * | 5/2008 | Ingram | A63B 21/4001 2/20 |
| 2009/0320178 | A1 | 12/2009 | Faulconer | |
| 2010/0000006 | A1 | 1/2010 | Butler | |
| 2010/0031411 | A1 | 2/2010 | Andrews | |
| 2010/0043113 | A1 | 2/2010 | Clark et al. | |
| 2011/0113530 | A1 | 5/2011 | Ballard et al. | |
| 2012/0017351 | A1 | 1/2012 | McCrane | |
| 2012/0283073 | A1 | 11/2012 | Zabel | |
| 2013/0000006 | A1 | 1/2013 | Norton et al. | |
| 2013/0198920 | A1 | 8/2013 | Wittman | |
| 2013/0232655 | A1 | 9/2013 | Bell | |
| 2013/0331236 | A1 | 12/2013 | Moss | |
| 2014/0213420 | A1 | 7/2014 | Harris | |
| 2014/0373247 | A1 | 12/2014 | Swaby | |
| 2015/0052655 | A1 | 2/2015 | McCully | |
| 2015/0057133 | A1 | 2/2015 | Nguyen | |
| 2015/0072579 | A1 | 3/2015 | Jack | |
| 2015/0148197 | A1 | 5/2015 | Lentz | |
| 2015/0367167 | A1 * | 12/2015 | Swaby | A63B 71/14 482/92 |
| 2017/0020212 | A1 | 1/2017 | Koven | |
| 2018/0140929 | A1 | 5/2018 | Pellegrino | |
| 2020/0046044 | A1 * | 2/2020 | Faim | A41D 13/082 |
| 2020/0246656 | A1 * | 8/2020 | Parent, Jr. | A63B 21/4021 |
| 2021/0023435 | A1 * | 1/2021 | Pellegrino | A63B 71/14 |

OTHER PUBLICATIONS

BearKomplex by Grinder's Gear Review dated Apr. 1, 2016. Found on line [Aug. 18, 2017] https://www.youtube.com/watch?v=TDNfermfmCY.

Bear by Bear Komplex dated Jun. 12, 2015. Found on line [Aug. 18, 2017] https://www.amazon.com/Bear-KompleX-gymnastics-Training-kettlebell/product-reviews/B0193G1U28/ref=cm_cr_arp_d_paging_btm_66?ie=UTF8&reviewerType=avp_only_reviews&sortBy=recent&pageNumber=66.

Rage Fitness, Product Catalog, Spring 2014, 2 pages.

Bear KompleX (@bearkomplex). "3hole in the tan leather will be ready next week." Instagram, May 30, 2015. https://www.instagram.com/p/3TIUF2gLG_/.

Bear KompleX (@bearkomplex). "Get a grip!" Instagram, Jun. 2, 2015. https://www.instagram.com/p/3boEHZgLCU/.

Bear KompleX (@bearkomplex). "New Bear KompleX hand grips coming soon. Get Better!" Instagram, May 26, 2015. https://www.instagram.com/p/3KN9oVALJD/.

Atleta Entrenando En CEFN CrossFit PicSil XStrong, YouTube, Jul. 30, 2015, https://www.youtube.com/watch?feature=player_detailpage&v=p0tpRWAfXO8&fbclid=IwAR0ldRYN1JsJMCsr9DS_d_wAy6Tbfubxu8W96TFNrbWhnpkFQC9ZXrlnJi8.

Bear KompleX, "And the Winner Is . . . " Giveaway Announcement, Facebook, Jun. 5, 2015, https://scontent-lht6-1.xx.fbcdn.net/v/t1.0-9/11400995_1611773892439971_4435730039633635652_n.jpg?_nc_cat=106&ccb=2&_nc_sid=9267fe&_nc_ohc=wd2-V5-Hl4UAX_I_kx4&_nc_ht=scontentlht6-1.xx&oh=82d60b5cf86d600238fabc00a44bd61d&oe=5FF455C7.

Bear KompleX, 3-Hole Grips and 2-Hole Grips Live on Amazon, Facebook, Jun. 6, 2015, https://scontent-lht6-1.xx.fbcdn.net/v/t1.0-9/11428949_1612477599036267_3553993455628088143_n.jpg?_nc_cat=106&ccb=2&_nc_sid=ba80b0&_nc_ohc=gf7kyeTxmloAX9iQFyC&_nc_ht=scontentlht6-1.xx&oh=7fbc3fd519755f88049174acca6bdb8f&oe=5FF38A0D.

Bear KompleX, Black 2-Hole Grips, Facebook, May 31, 2015. https://scontent-lht6-1.xx.fbcdn.net/v/t1.0-9/11377176_1610074795943214_895316927219346523 1_n.jpg?_nc_cat=103&ccb=2&_nc_sid=8bfeb9&_nc_ohc=kD0fHGOgj44AX9KGW4f&_nc_ht=scontentlht6-1.xx&oh=492264c4a0f64361b425641f75306b49&oe=5FF5AED1.

Bear KompleX, Black 3-Hole Grips, Facebook, Jun. 1, 2015, https://scontent-lht6-1.xx.fbcdn.net/v/t1.0-9/1535736_1610502202567140_2101526561166983864_n.jpg?_nc_cat=105&ccb=2&_nc_sid=174925&_nc_ohc=ZADWXjmF5EEAX8koYiX&_nc_ht=scontentlht6-1.xx&oh=539e9e1dbb5b50e3d55ca05fc08f73b4&oe=5FF68C4C.

Bear KompleX, Giveaway/Tan 2-Hole Grips, Facebook, Jun. 4, 2015, https://scontent-lhr8-1.xx.fbcdn.net/v/t1.0-9/11390103_1611543785796315_5604541899228397213_n.jpg?_nc_cat=107&ccb=2&_nc_sid=9267fe&_nc_ohc=aAy64EkPc90AX9_ko0f&_nc_ht=scontentlhr8-1.xx&oh=8dd6588f4da27f42833160666d786a77&oe=5FF45E47.

Bear KompleX, New Grips Available This Friday, Facebook, Jun. 2, 2015, https://www.facebook.com/bearkomplex/posts/1610693159214711.

Bear KompleX, Tan 3-Hole Grips, Facebook, May 31, 2015, https://scontent-lhr8-1.xx.fbcdn.net/v/t1.0-9/10012530_1610074809276546_2266866724229452598_n.jpg?_nc_cat=109&ccb=2&_nc_sid=8bfeb9&_nc_ohc=TlwRawaJqwcAX8_z2xZ&_nc_ht=scontentlhr8-1.xx&oh=5eeb75b20ee3239926cd3af080cee92f&oe=5FF690A6.

(56) References Cited

OTHER PUBLICATIONS

Bear KompleX. Black 2-Hole Grips and Tan 3-Hole Grips, Facebook, May 31, 2015, https://www.facebook.com/bearkomplex/posts/1610075045943189.

GRIPS—Crossfit, Gymnastics, Hand, Pull Up—Premium Leather Grips, Facebook, Jul. 22, 2015, https://scontent-lhr8-1.xx.fbcdn.net/v/t31.0-8/11728866_1467587453559329_3017324633488928411_o.jpg?_nc_cat=102&ccb=2&_nc_sid=e3f864&_nc_ohc=v453o_LD0hAAX-W7y_s&_nc_ht=scontentlhr8-1.xx&oh=35142f07fbeb1b9f215a9a174ce0cc86&oe=5FDC31EF.

Joshua Wacks, Girls Gymnastic Grips, Facebook, May 28, 2015, https://scontent-lht6-1.xx.fbcdn.net/v/t1.0-9/11329986_10206343410974747_2147993998531585949_n.jpg?_nc_cat=105&ccb=2&_nc_sid=825194&_nc_ohc=Nr3BfcOsF7wAX8UFTSW&_nc_ht=scontentlht6-1.xx&oh=8873afcf9af709ba0beaa047e26f5b42&oe-5FDDD554.

Picsil, 2-Hole Hand Grips, Facebook, Jul. 31, 2015, https://scontent-lht6-1.xx.fbcdn.net/v/t1.0-9/11885267_949234711804473_5924080080783064960_n.jpg?_nc_cat=108&ccb=2&_nc_sid=19026a&_nc_ohc=w2WwOG4H6GQAX8Gk4C3&_nc_oc=AQmCQ_ODOE1hhQiAMhWitwf_XW4eFEZ_oKj4lLEw13IPMssFzlxNuql1h9qtpNWnWw&_nc_ht=scontentlht6-1.xx&oh=93be5a83dc447dc75f7ef8dbb51886a8&oe=5FDE0832.

Picsil, 3-Hole Hand Grips and 2-Hole Hand Grips, Facebook, Aug. 28, 2015, https://scontent-lht6-1.xx.fbcdn.net/v/t1.0-9/11885267_949234711804473_5924080080783064960_n.jpg?_nc_cat=108&ccb=2&_nc_sid=19026a&_nc_ohc=w2WwOG4H6GQAX8Gk4C3&_nc_oc=AQmCQ_ODOEIhhQiAMhWitwf_XW4eFEZ_oKj4ILEw13IPMssFzlxNuql1h9qtpNWnWw&_nc_ht=scontentlht6-1.xx&oh=93be5a83dc447dc75f7ef8dbb51886a8&oe=5FDE0832.

Picsil, XStrong Hand Grip, Facebook, Jun. 7, 2015, https://scontent-lhr8-1.xx.fbcdn.net/v/t1.0-9/11406928_907393562655255_2601550978684719627_n.jpg?_nc_cat=107&ccb=2&_nc_sid=8bfeb9&_nc_ohc=nNI7R5kjfbsAX_d3nOP&_nc_ht=scontentlhr8-1.xx&oh=3f2823b2e8bc4066d86c1ee3daffc632&oe=5FDCD5DE.

Protein Power Supplements, NutriTech ProGear Lifting Straps, Facebook, May 27, 2015, https://scontent-lhr8-1.xx.fbcdn.net/v/t1.0-9/10423901_1494994014082629_3755309500068675856_n.jpg?_nc_cat=104&ccb=2&_nc_sid=cdbe9c&_nc_ohc=qNP5v-ICJEoAX-GHAGd&_nc_ht=scontentlhr8-1.xx&oh=826ec96828fcc10f332908f7d29f3284&oe=5FDF26C3.

Stacie Tovar, The Natural Grip, Facebook, Feb. 28, 2015, https://scontent-lht6-1.xx.fbcdn.net/v/t31.0-8/11038427_1618395328381536_9028346268946195329_o.jpg?_nc_cat=106&ccb=2&_nc_sid=ba80b0&_nc_ohc=PhJjWS-xZUAX8p16WN&_nc_ht=scontentlht6-1.xx&oh=ba2f071cc2821e342af2616330f64caf&oe=5FDC65B9.

Amazon.com: Best Gymnastics Grips for Maximum Hand Protection; https://www.amazon.com/Gymnastics-Protection-Mternative-Crossfit-Weightlifting/dp/BOOYT8EB5E/; date first available identified as Jun. 3, 2015; website visited on Nov. 18, 2021; 8 pages.

* cited by examiner

ATHLETIC HAND GRIPS

CROSS REFERENCE TO RELATED APPLICATION

This application claims priority to U.S. Provisional Patent Application Ser. No. 62/345,646, filed Jun. 3, 2016, the disclosure of which is hereby expressly incorporated by reference herein in its entirety.

FIELD OF THE DISCLOSURE

The present disclosure relates to athletic hand grips and methods of using the same.

BACKGROUND OF THE DISCLOSURE

Hand grips may be worn during an athletic activity to protect a user's hands. However, existing hand grips may be uncomfortable to wear and may provide inadequate protection.

SUMMARY

The present disclosure provides athletic hand grips and methods of using the same. The hand grips may be provided in pairs and worn on both hands to protect the user's palms, in particular. The hand grips may be worn during various athletic activities, including weight lifting, CrossFit activities, and gymnastics, for example.

According to an exemplary embodiment of the present disclosure, an athletic grip is disclosed for use on a user's hand, the grip including a pad configured to be positioned on the user's palm, a wrist strap configured to be positioned on the user's wrist, and a belt including a buckle configured to secure the wrist strap around the user's wrist, wherein the wrist strap is positioned beneath the buckle such that the wrist strap separates the buckle from the user's wrist.

According to another exemplary embodiment of the present disclosure, an athletic grip is disclosed for use on a user's hand, the grip including a pad configured to be positioned on the user's palm, the pad including a plurality of finger holes, a cutout in a medial side configured to be positioned near the user's thumb, and an extension on a lateral side configured to be positioned near the user's small finger, a wrist strap configured to be positioned on the user's wrist, and a belt configured to secure the wrist strap around the user's wrist.

According to yet another exemplary embodiment of the present disclosure, a method is disclosed for securing an athletic grip to a user's hand, the method including positioning a pad on the user's palm, securing a belt having a buckle around the user's wrist, and positioning a wrist strap beneath the buckle to separate the buckle from the user's wrist.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

A first athletic hand grip 100 is shown in FIGS. 1-9. Grip 100 includes a pad 110, a wrist strap 120, and an adjustable belt 130.

Figure 8:
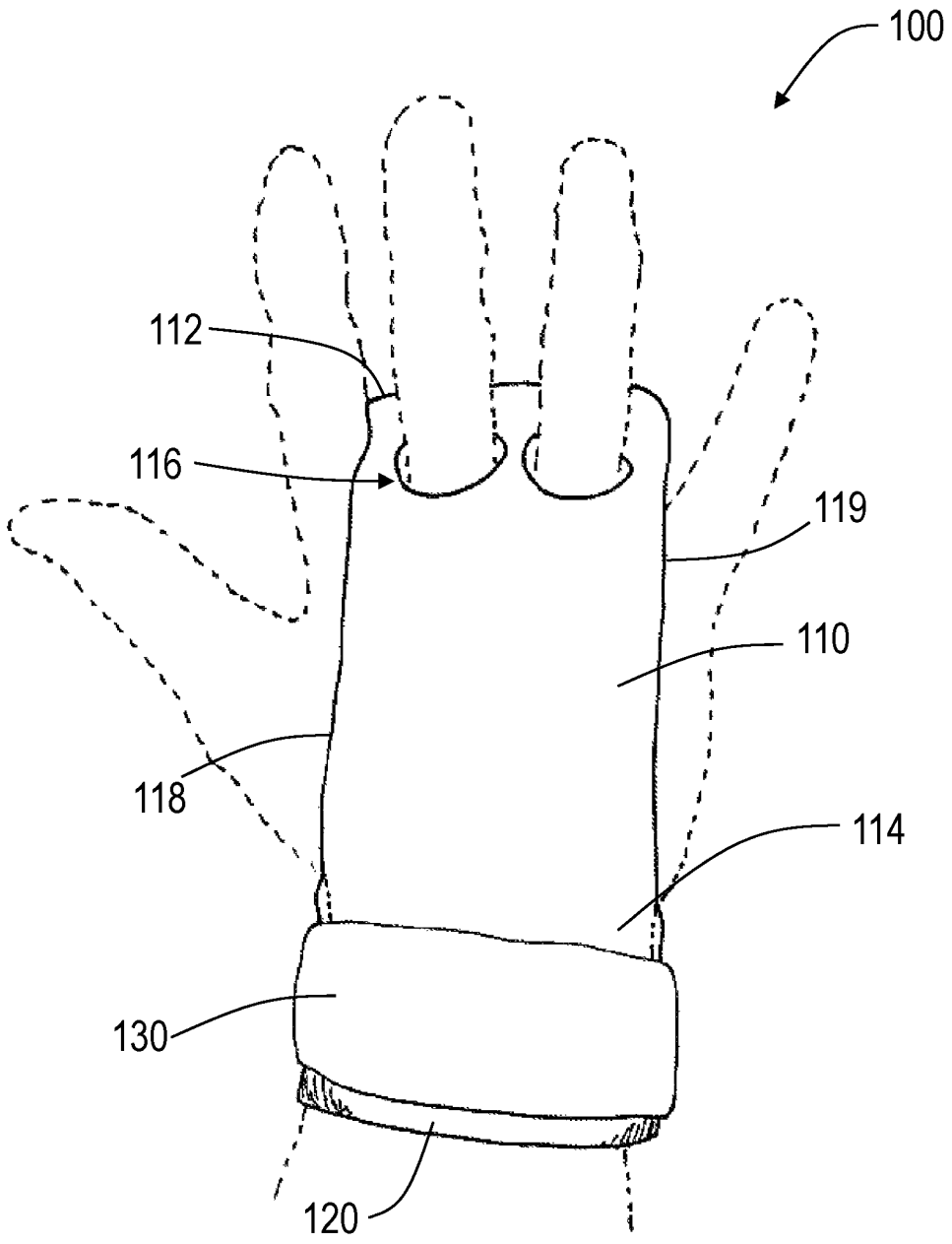
FIG. 8 is a front elevational view similar to FIG. 2 and shows the first athletic hand grip being worn on a user's hand.

Pad 110 is generally flat and rectangular in shape and is sized to at least partially cover a user's palm, as shown in FIG. 8. An exemplary pad 110 will cover a majority of the user's palm. Pad 110 may be constructed of leather, synthetic leather, fabric, or another suitable material to protect the user's palm. Pad 110 is flexible and is configured for movement with the user's hand. For example, when the user closes his hand to grip a bar, pad 110 will mimic the shape of the user's hand around the bar. Pad 110 includes a top end 112 configured for positioning near the user's fingers and a bottom end 114 configured for positioning near the user's wrist. Pad 110 also includes a medial side 118 configured for positioning near the user's thumb and a lateral side 119 configured for positioning near the user's small or pinky finger.

Figure 9:
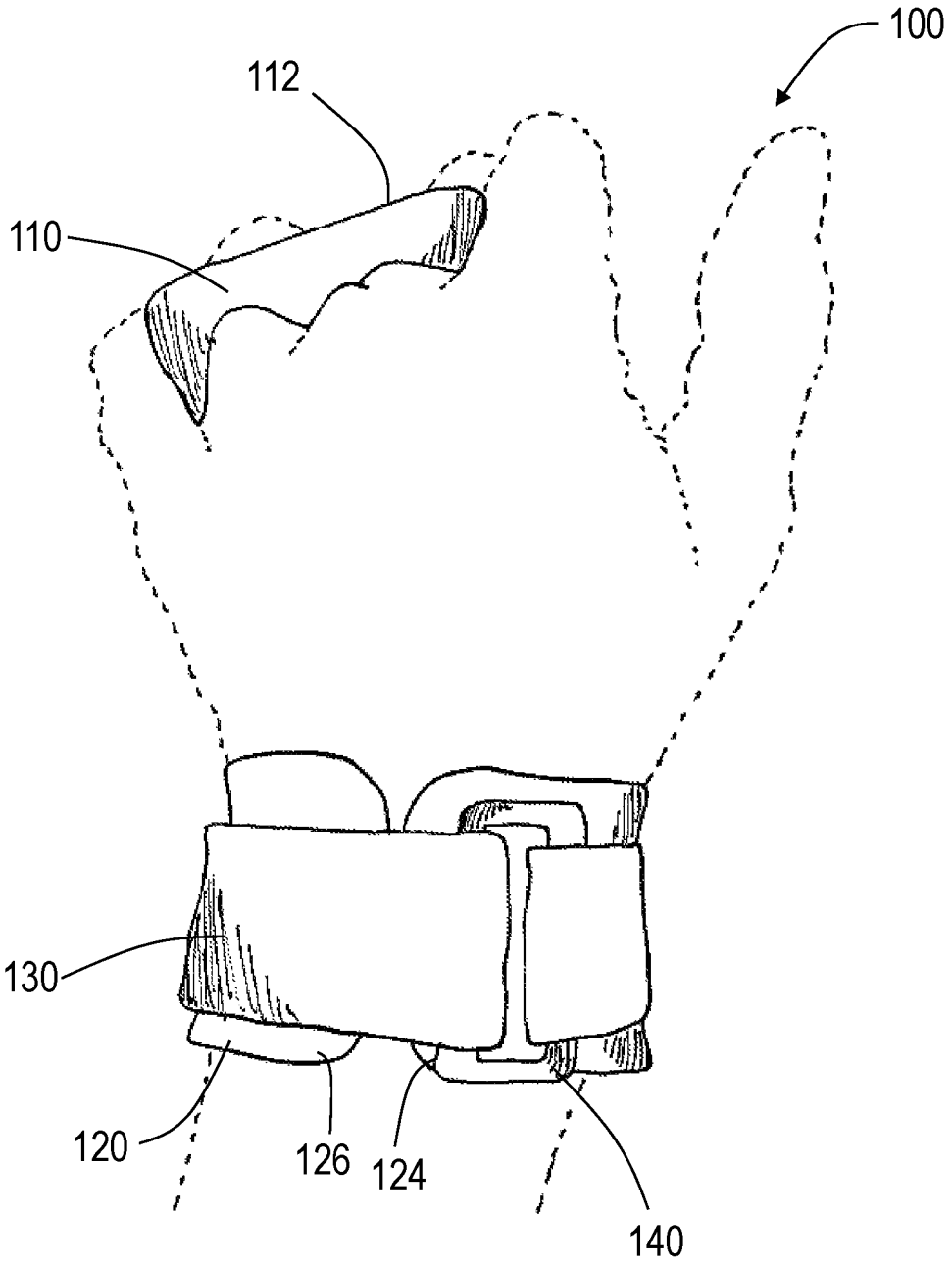
FIG. 9 is a rear elevational view similar to FIG. 3 and shows the first athletic hand grip being worn on the user's hand.
Figure 10:
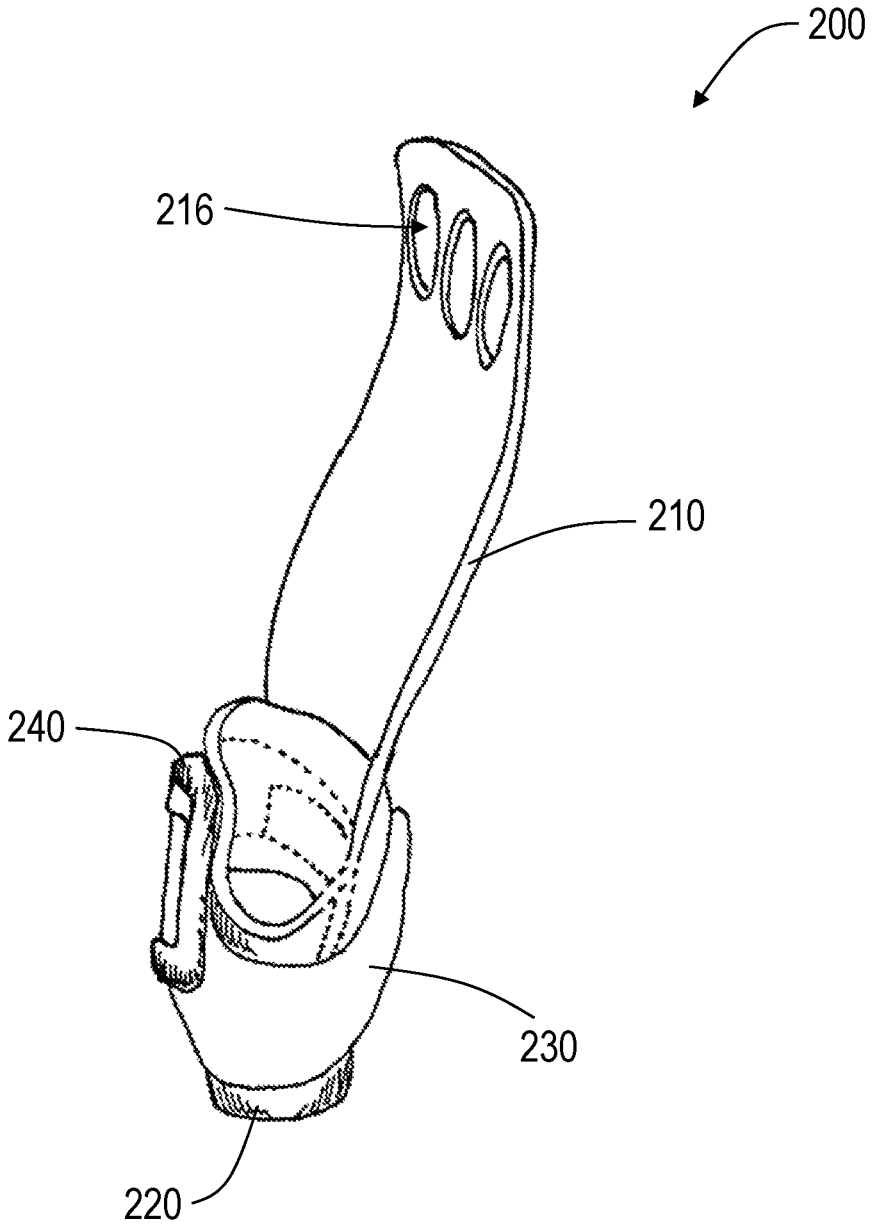
FIG. 10 is a perspective view of a second athletic hand grip.
Figure 11:
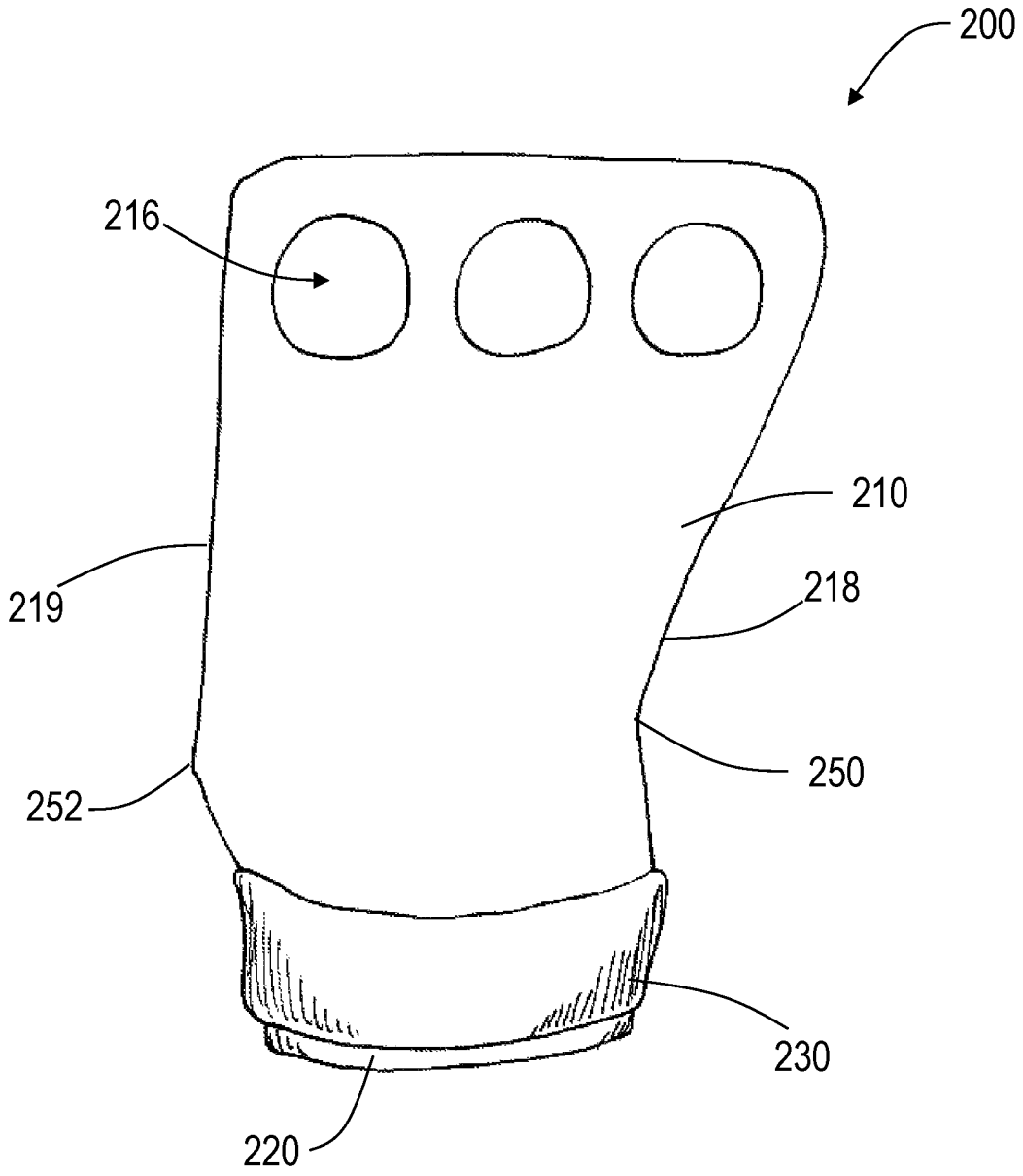
FIG. 11 is a front elevational view of the second athletic hand grip of FIG. 10.
Figure 12:
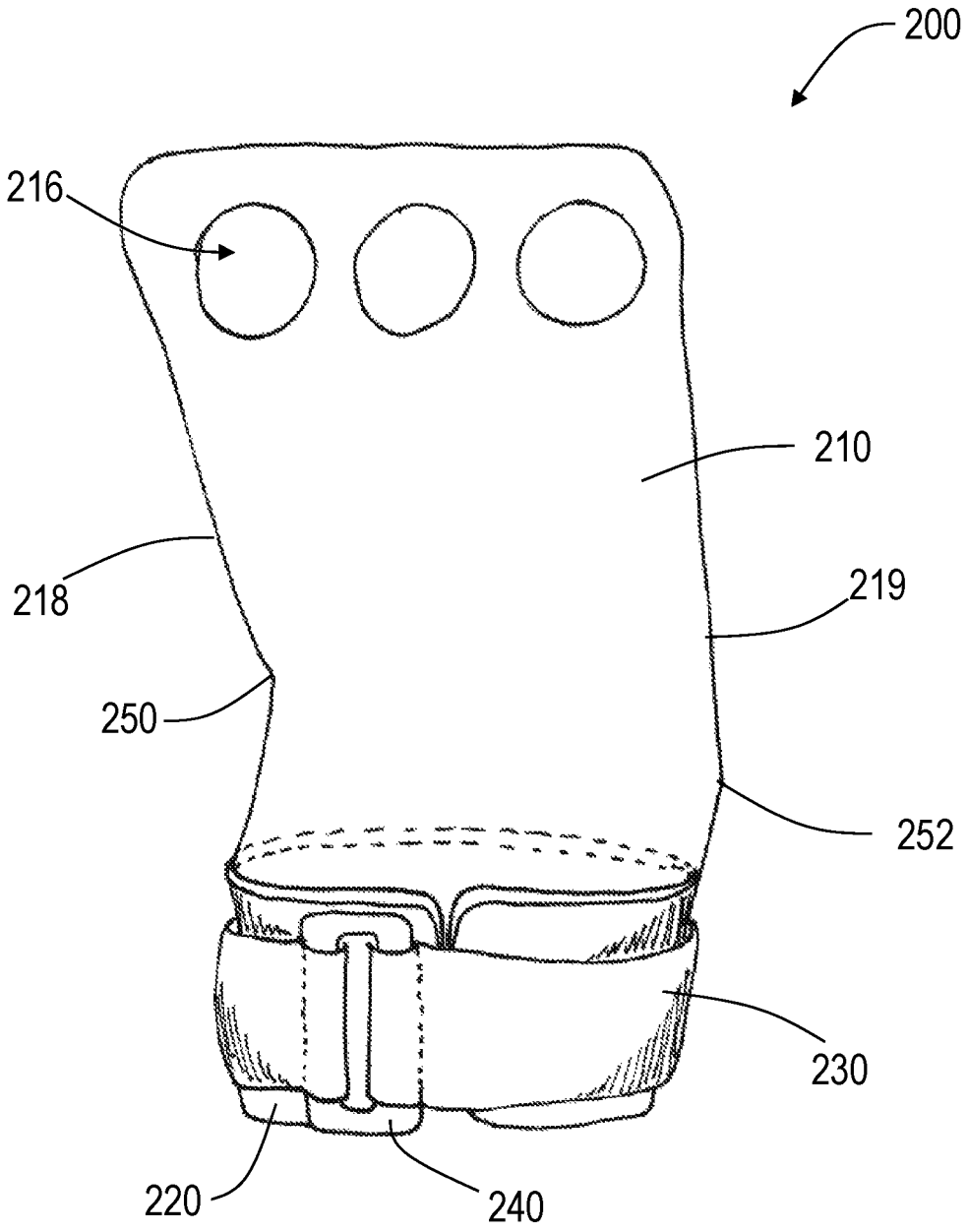
FIG. 12 is a rear elevational view of the second athletic hand grip of FIG. 10.
Figure 13:
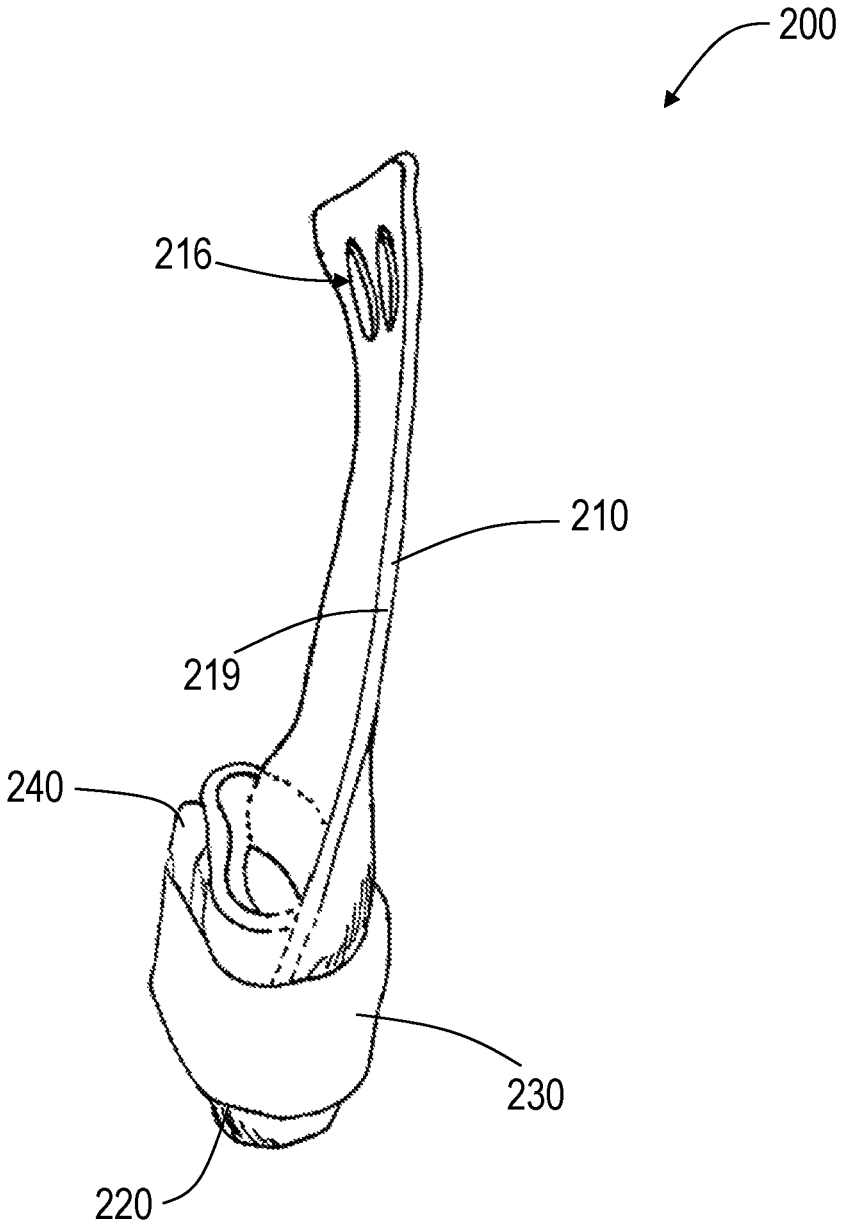
FIG. 13 is a side elevational view of the second athletic hand grip of FIG. 10.
Figure 14:
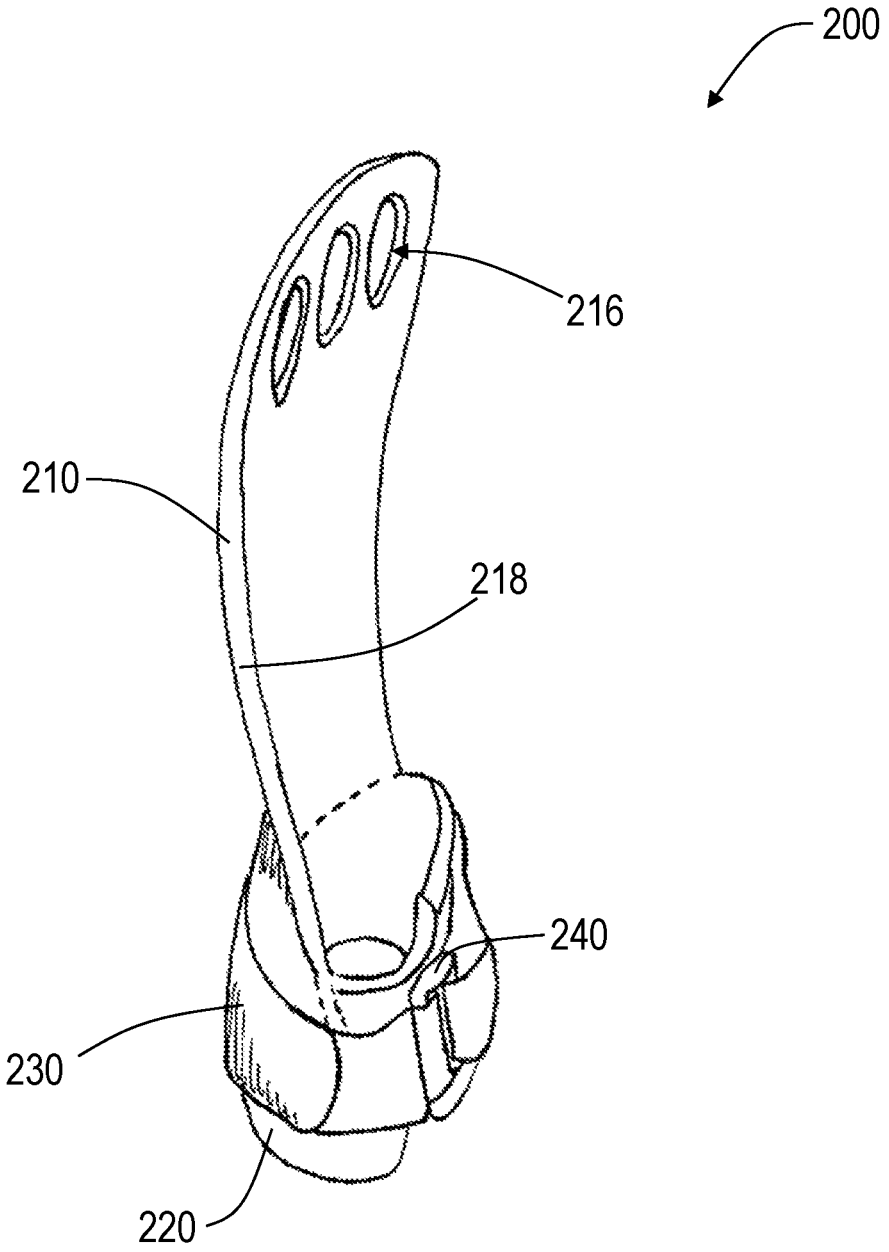
FIG. 14 is another side elevational view of the second athletic hand grip of FIG. 10.
Figure 15:
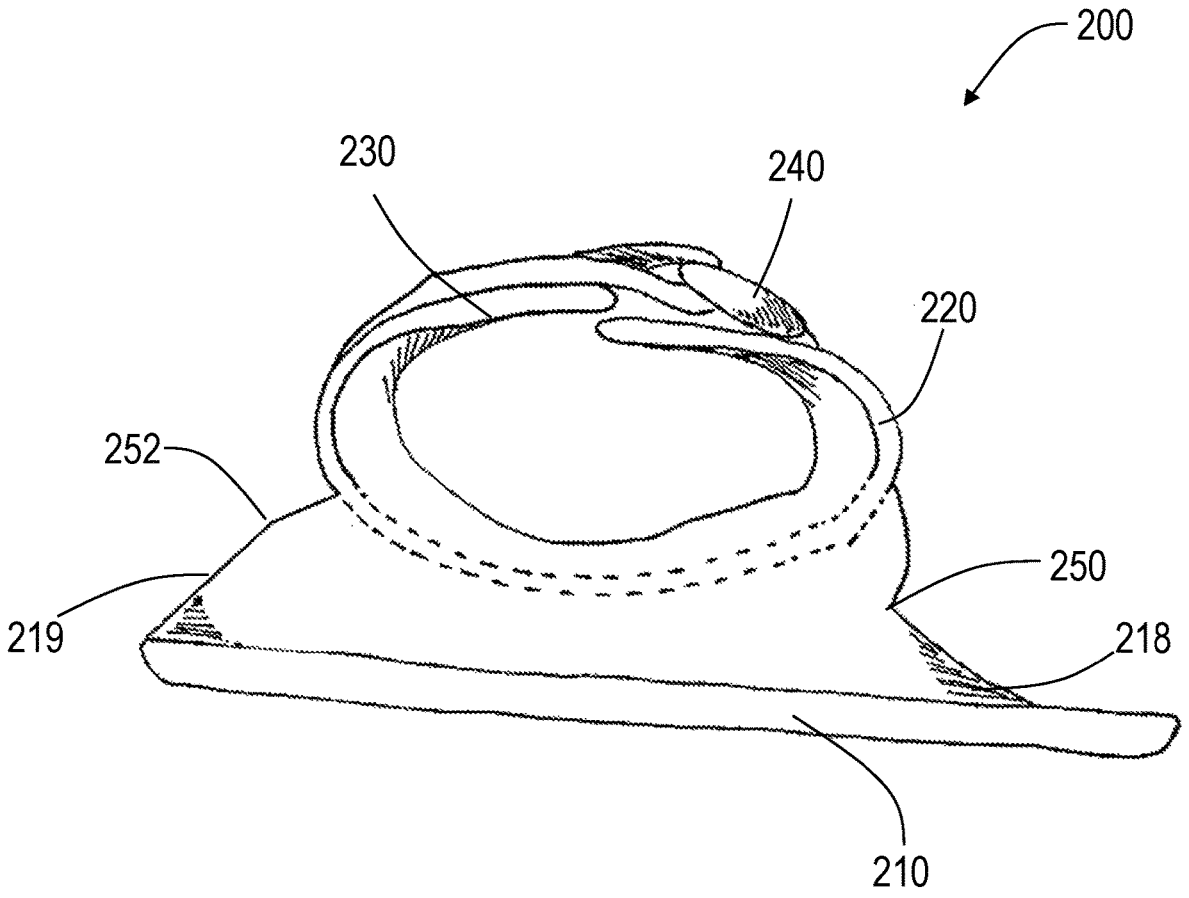
FIG. 15 is a top plan view of the second athletic hand grip of FIG. 10.
Figure 16:
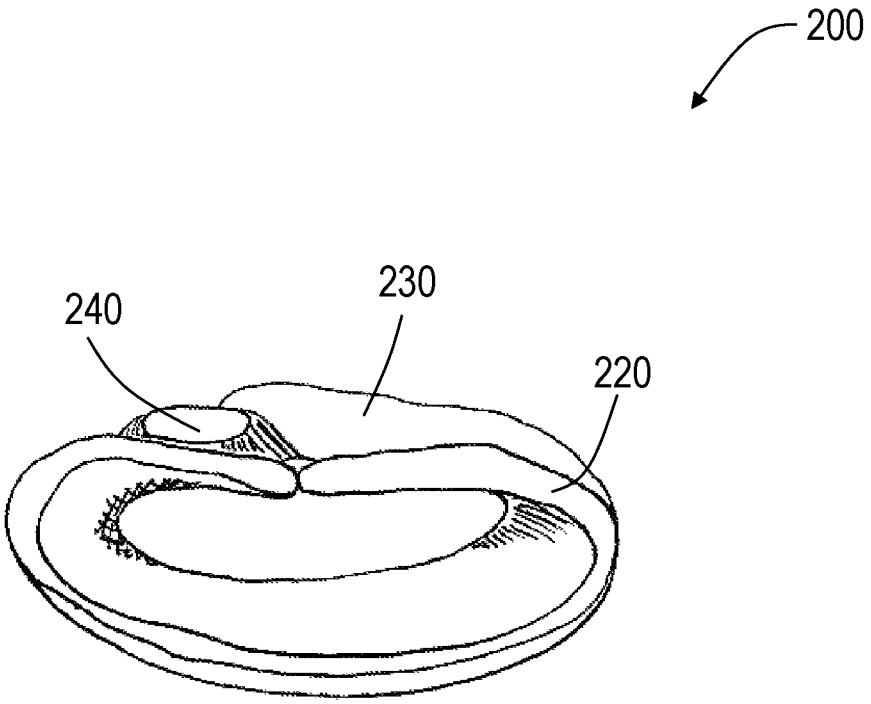
FIG. 16 is a bottom plan view of the second athletic hand grip of FIG. 10.

Near top end 112, pad 110 defines one or more finger holes 116. Each finger hole 116 may be circular in shape and sized to receive a corresponding finger. The illustrative grip 100 includes two finger holes 116 configured to receive the user's middle finger and ring finger, as shown in FIGS. 8 and 9.

Near bottom end 114, pad 110 is coupled to wrist strap 120. More specifically, pad 110 is coupled to middle portion 122 of wrist strap 120. Wrist strap 120 may be constructed of leather, synthetic leather, fabric, or another suitable material. In certain embodiments, wrist strap 120 may be constructed of the same material as pad 110. Wrist strap 120 is flexible and is configured for adjustment around the user's wrist. Wrist strap 120 may be sewn, adhered, or otherwise coupled to pad 110. It is also within the scope of the present disclosure for wrist strap 120 to be integrally formed with pad 110 from a single piece of material. On either side of middle portion 122, wrist strap 120 includes free ends 124 and 126 that extend laterally from pad 110 and wrap around the user's wrist, as shown in FIG. 9.

Figure 1:
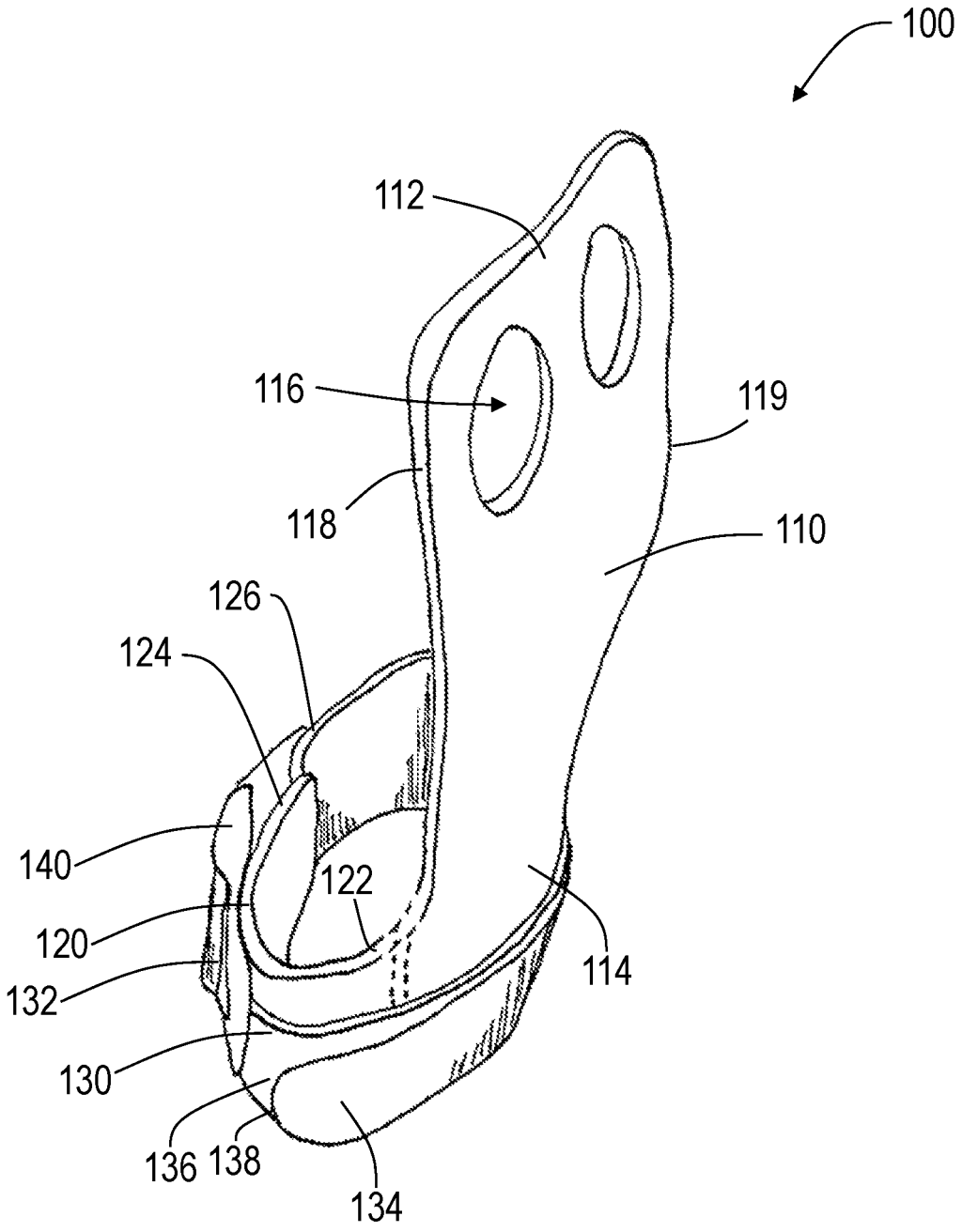
FIG. 1 is a perspective view of a first athletic hand grip.
Figure 2:
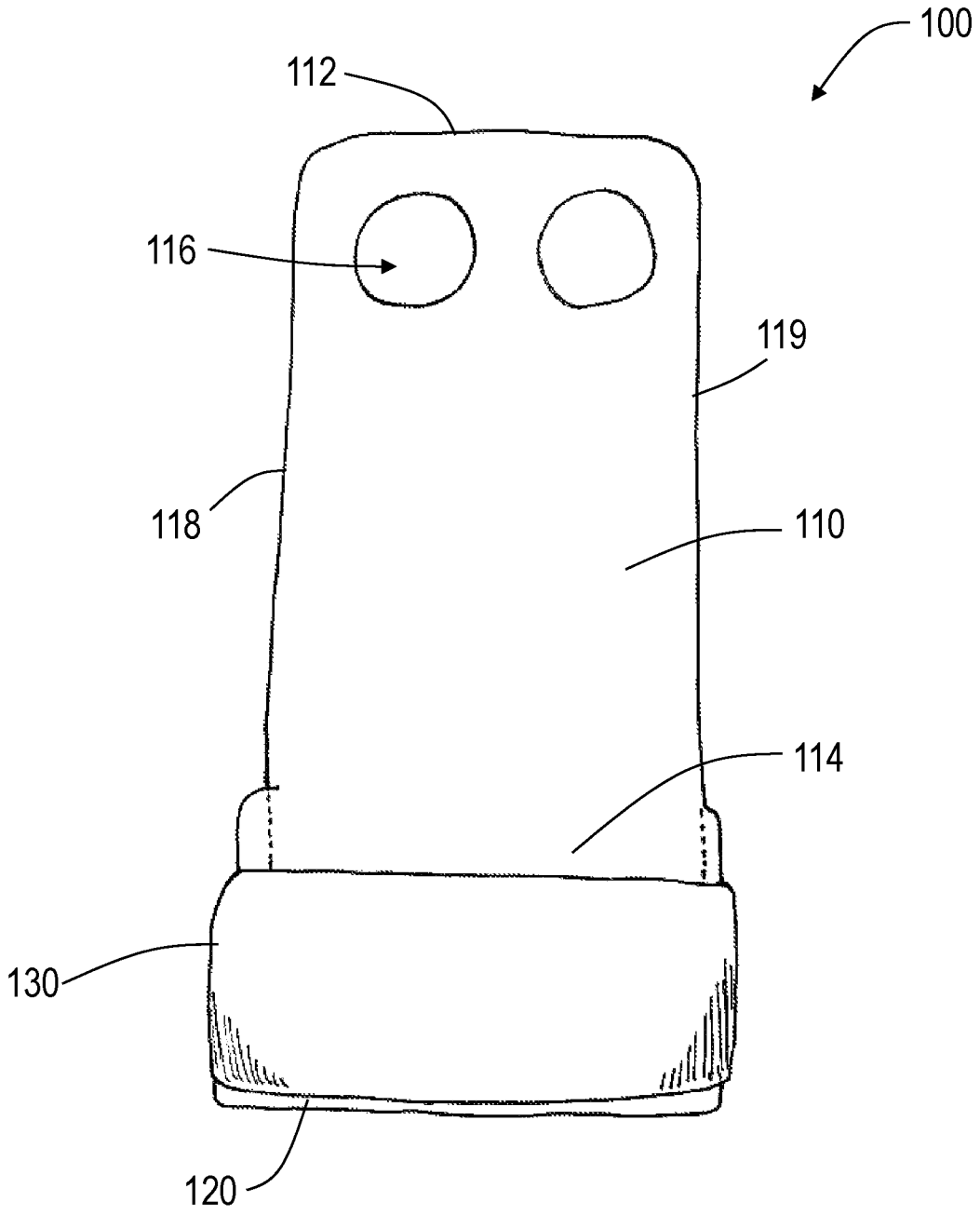
FIG. 2 is a front elevational view of the first athletic hand grip of FIG. 1.
Figure 3:
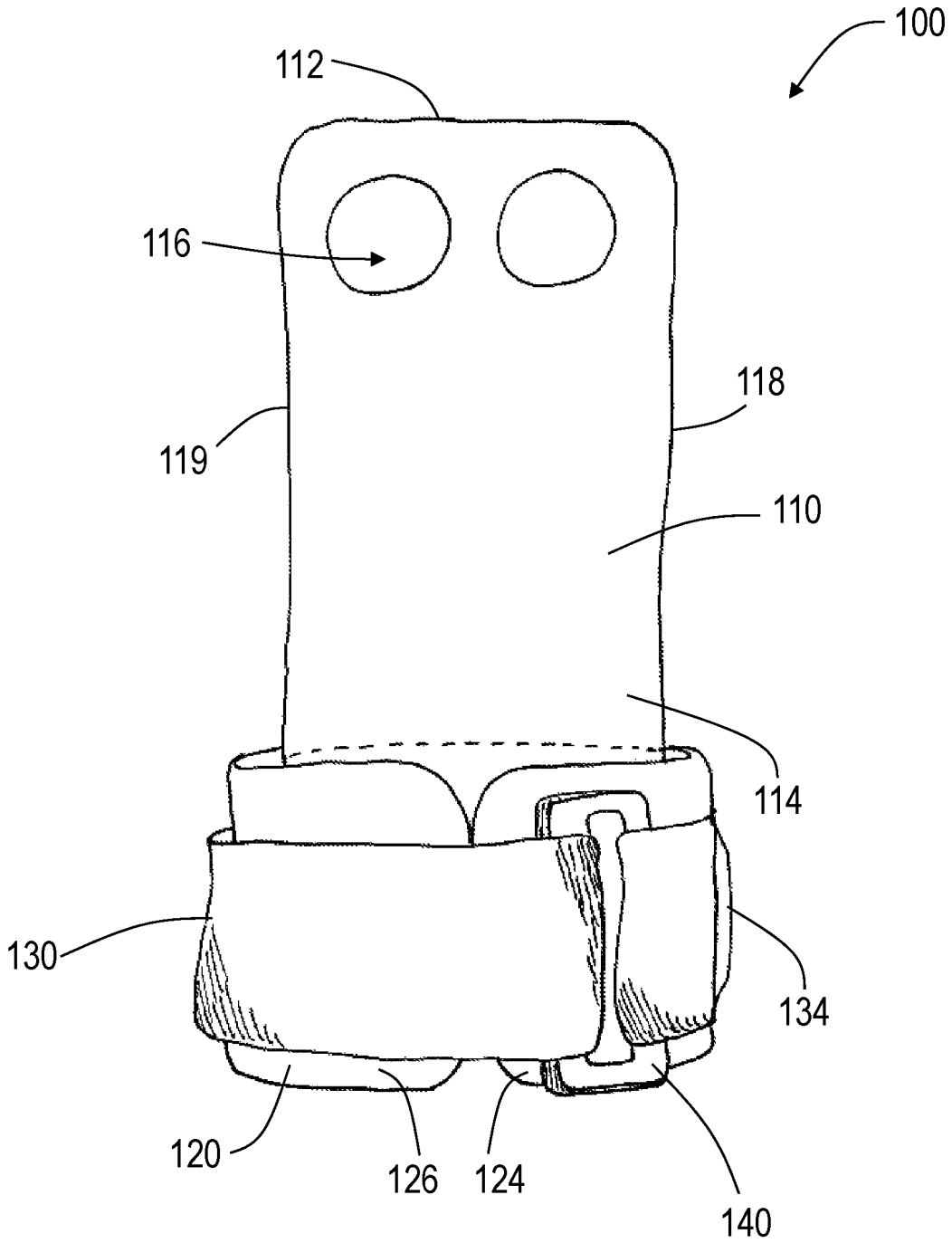
FIG. 3 is a rear elevational view of the first athletic hand grip of FIG. 1.
Figure 4:
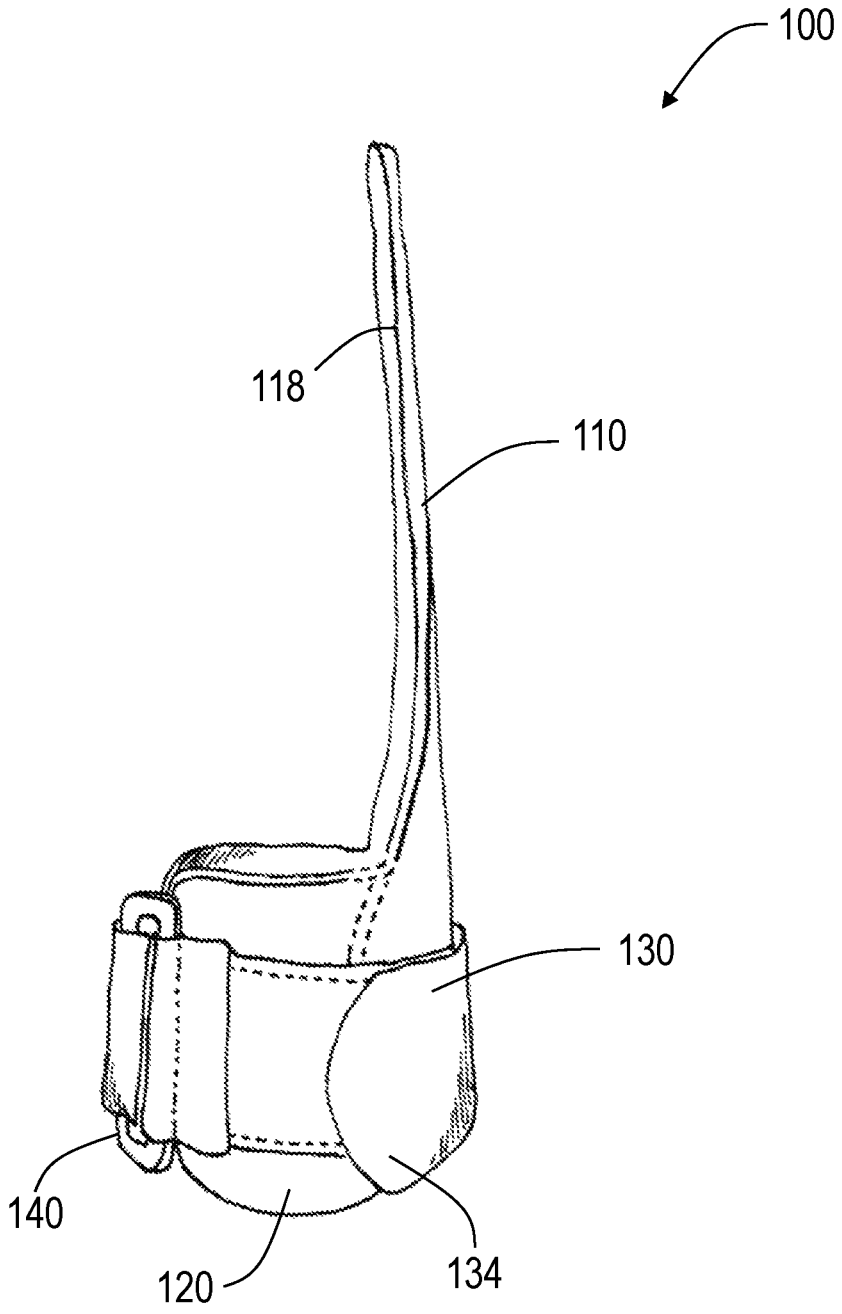
FIG. 4 is a side elevational view of the first athletic hand grip of FIG. 1.
Figure 5:
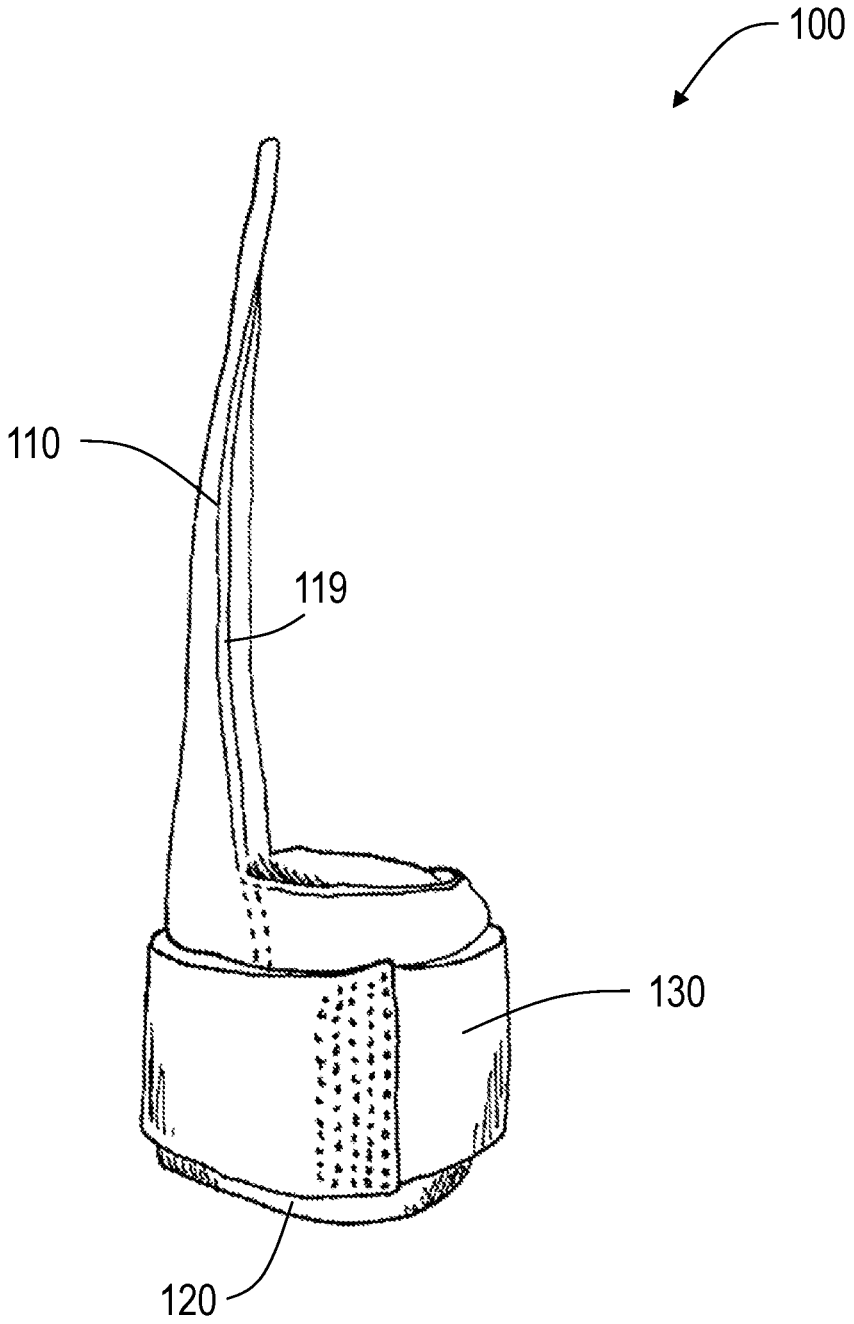
FIG. 5 is another side elevational view of the first athletic hand grip of FIG. 1.
Figure 6:
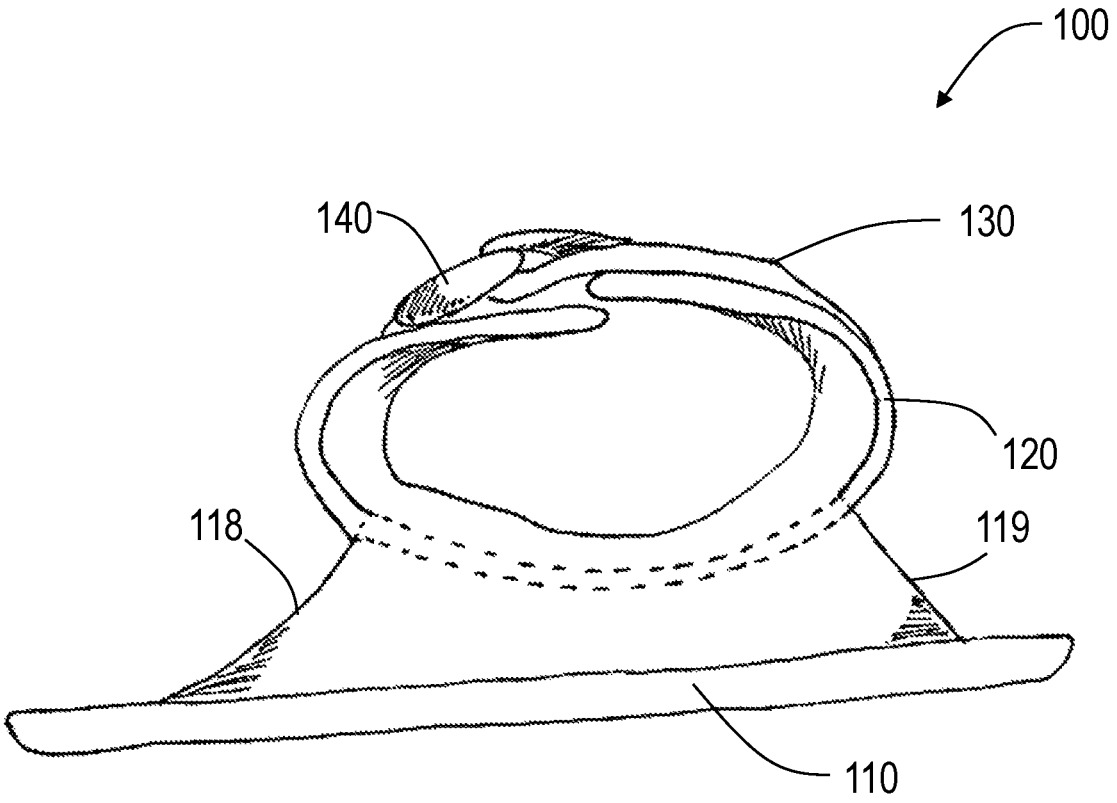
FIG. 6 is a top plan view of the first athletic hand grip of FIG. 1.
Figure 7:
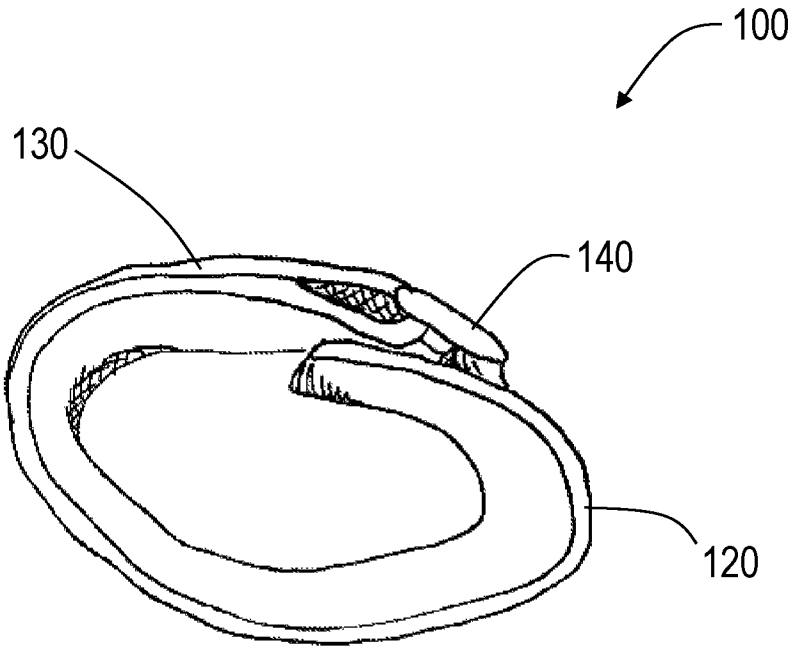
FIG. 7 is a bottom plan view of the first athletic hand grip of FIG. 1.

Belt 130 is coupled to wrist strap 120 and is configured to hold wrist strap 120 securely in place on the user's wrist. Belt 130 may be sewn, adhered, or otherwise coupled to wrist strap 120. The illustrative belt 130 includes a first end 132 located at or near end 124 of wrist strap 120 and a second free end 134. Near first end 132, belt 130 includes a buckle 140 and a first fastener 136 located on the front side of belt 130. Near second end 134, belt 130 includes a second fastener 138 located on the back side of belt 130 that is compatible with the first fastener 136. For example, the first fastener 136 may include a loop material and the second fastener 138 may include a hook material to achieve a Velcro-type fastening. Other suitable fasteners include snaps and buttons, for example. The first end 132 of belt 130 may be permanently coupled to the buckle 140 (for example, sewn, adhered, or otherwise fixedly coupled to buckle 140, and the second free end 134 of belt 130 may be adjustably coupled to buckle 140. In use, the second free end 134 of belt 130 is looped around buckle 140 and attached to the first end 132 of belt 130, as shown in FIG. 1, to hold wrist strap 120 tightly and securely in place around the user's wrist, as shown in FIGS. 8 and 9.

According to an exemplary embodiment of the present disclosure, wrist strap 120 is located beneath all or a portion of belt 130 to separate belt 130 from the user's skin. In particular, wrist strap 120 is located beneath buckle 140 of belt 130 to separate the hard plastic material of buckle 140 from the user's skin. In this arrangement, wrist strap 120 may be constructed of a relatively soft and more comfortable material (e.g., leather) for placement against the user's skin, while buckle 140 and the other components of belt 130 may be constructed of relatively rigid and less comfortable materials (e.g., plastic) and separated from the user's skin.

Figure 17:
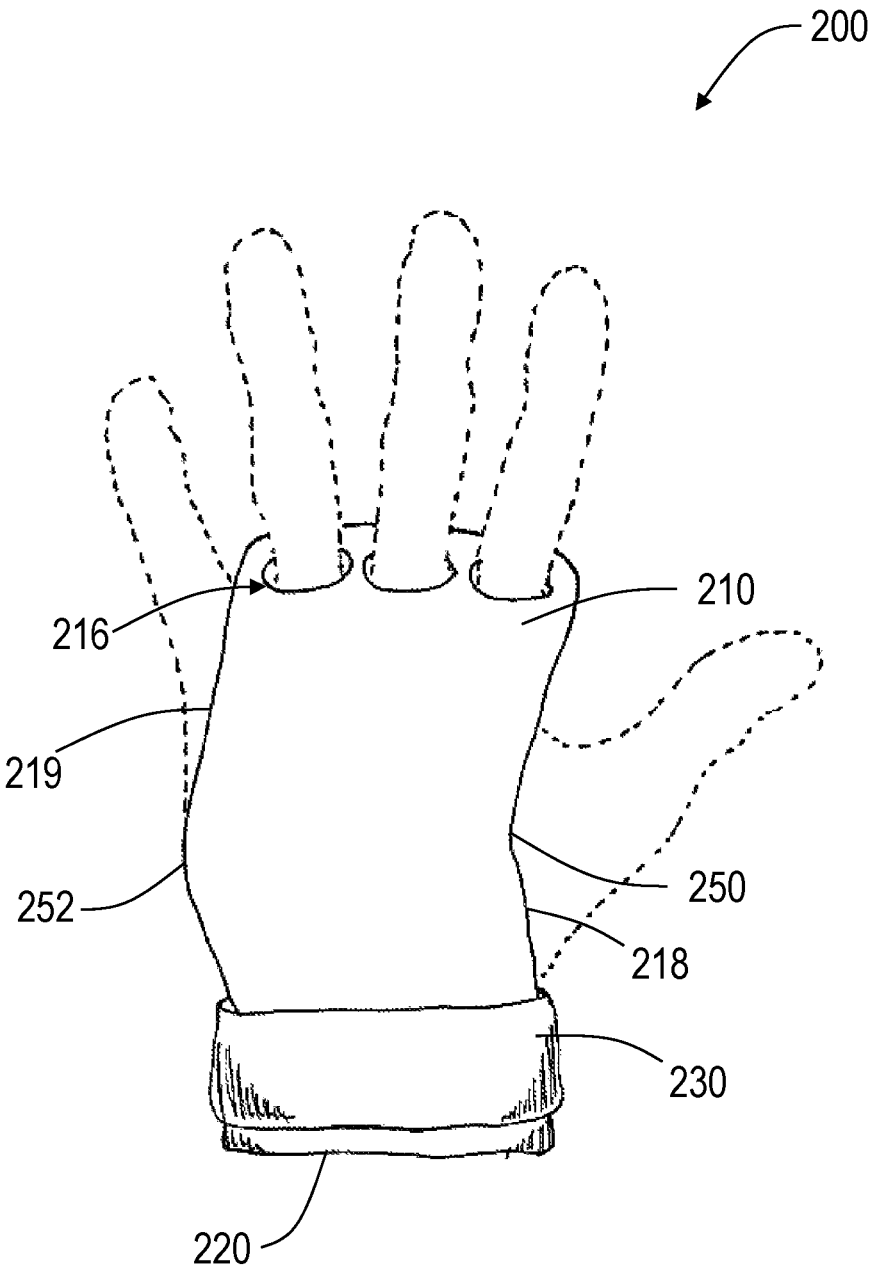
FIG. 17 is a front elevational view similar to FIG. 11 and shows the second athletic hand grip being worn on a user's hand.
Figure 18:
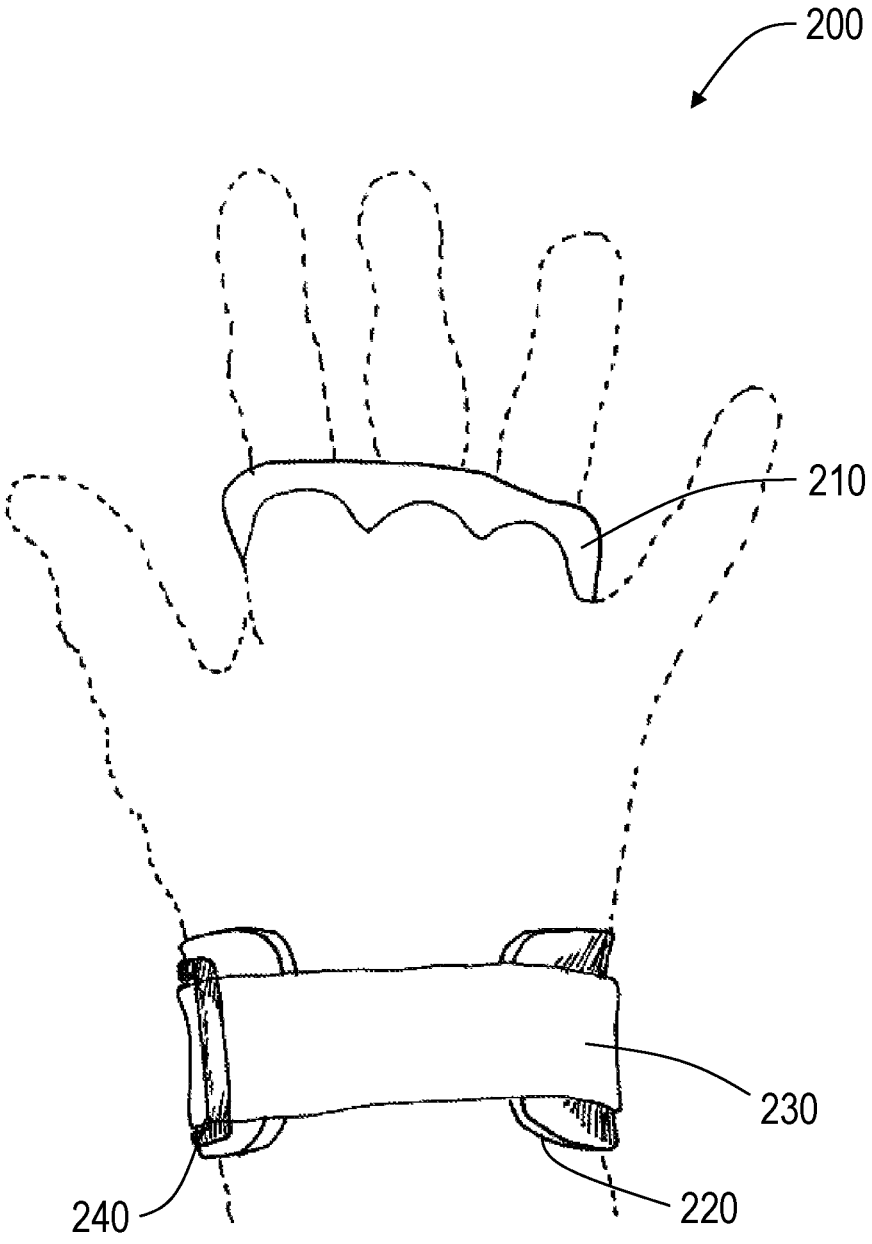
FIG. 18 is a rear elevational view similar to FIG. 12 and shows the second athletic hand grip being worn on the user's hand.

A second athletic hand grip 200 is shown in FIGS. 10-18 and includes a pad 210, a wrist strap 220, and a belt 230 with a buckle 240. Grip 200 of FIGS. 10-18 is similar to grip 100 of FIGS. 1-9, except as described herein. Pad 210 of grip 200 includes three finger holes 216 configured to receive the user's index finger, middle finger, and ring finger, as shown in FIG. 17. Pad 210 also includes a medial cutout 250 in the medial side 218 near the user's thumb to allow for thumb mobility and a lateral extension 252 on the lateral side 219 near the user's small or pinky finger to provide for more palm coverage. Cutout 250 in the medial side 218 of pad 210 may be substantially vertically aligned with extension 252 on the lateral side 219 of pad 210. As a result, pad 210 may have a bent appearance. In some embodiments, an outer-most portion of extension 252 on the lateral side 219 of pad 210 is closer to wrist strap 220 than an inner-most portion of cutout 250 in the medial side 218 of pad 210. Illustratively, the cutout 250 provides the medial side 218 with a concave shape and the extension 252 provides the lateral side 219 with a convex shape.

Grips 100 and 200 may be provided in pairs and worn on both of the user's hands. Grips 100 and 200 within each pair may be mirror images of each other. Grips 100 and 200 may be worn during various athletic activities, including weight lifting, CrossFit activities, and gymnastics, for example. Grips 100 and 200 may be provided in various sizes to accommodate different users, from children to adults.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An athletic grip configured for use on a user's hand, the grip consisting essentially of:
   - a pad configured to be positioned on the user's palm, wherein an upper end of the pad defines a plurality of finger holes;
   - a wrist strap configured to be positioned on the user's wrist, the wrist strap comprising a free end; and
   - a belt including a buckle, a first fastener, and a second fastener compatible with the first fastener, the belt being configured to secure the wrist strap around the user's wrist;
   - wherein the wrist strap is configured to be disposed between the buckle and the user's skin and the belt and the user's skin and the free end extends laterally beyond the buckle such that the wrist strap prevents the buckle from directly contacting the user's skin, wherein the pad includes an extension on a lateral side configured to be positioned near the user's small finger, and wherein an outer-most portion of the extension on the lateral side is closer to the wrist strap than an inner-most portion of a cutout in a medial side of the pad configured to be positioned near the user's thumb.

2. The grip of claim 1, wherein:
   - the wrist strap is constructed of a relatively soft material compared to the buckle; and
   - the buckle is constructed of a relatively rigid material compared to the wrist strap.

3. The grip of claim 2, wherein:
   - the wrist strap is constructed of leather, synthetic leather, or fabric; and
   - the buckle is constructed of plastic.

4. The grip of claim 1, wherein the pad and the wrist strap are formed from a single piece of material.

5. The grip of claim 1, wherein the pad and the wrist strap are formed from multiple pieces of material coupled together.

6. The grip of claim 1, wherein:
   - a first end of the belt is permanently coupled to the buckle; and
   - a second end of the belt is looped through the buckle and removably coupled to the first end of the belt.

7. The grip of claim 1, wherein the pad is sized such that, when a plurality of the user's fingers are positioned in the plurality of corresponding finger holes, tips of the user's fingers extend beyond the pad and the upper end of the pad is positioned near bases of the user's fingers.

8. The grip of claim 1, wherein the free end of the wrist strap is a first free end and the wrist strap further comprises a second free end, and the second free end is configured to be disposed between the belt and the user's skin.

9. An athletic grip configured for use on a user's hand, the grip comprising:

a pad configured to be positioned on the user's palm, the pad including:

a plurality of finger holes;

a cutout in a medial side configured to be positioned near the user's thumb, the cutout providing the medial side with a concave shape; and an extension on a lateral side configured to be positioned near the user's small finger, the extension providing the lateral side with a convex shape;

a wrist strap configured to be positioned on the user's wrist; and a belt configured to secure the wrist strap around the user's wrist;

wherein the convex shape provided by the extension is disposed between the plurality of finger holes and the belt, and the convex shape is disposed nearer to the belt than the convex shape is disposed to the plurality of finger holes.

10. The grip of claim 9, wherein an outer-most portion of the extension is closer to the wrist strap than an inner-most portion of the cutout.

11. The grip of claim 9, wherein the belt includes a buckle positioned on top of the wrist strap such that the wrist strap separates the buckle from the user's wrist.

12. The grip of claim 11, wherein:

the wrist strap is constructed of a relatively soft material compared to the buckle; and the buckle is constructed of a relatively rigid material compared to the wrist strap.

13. The grip of claim 9, wherein the plurality of finger holes includes:

a first finger hole configured to receive the user's middle finger; and a second finger hole configured to receive the user's ring finger.

14. The grip of claim 13, wherein the plurality of finger holes further includes a third finger hole configured to receive the user's index finger.

15. The grip of claim 9, wherein the pad and the wrist strap are formed from a single piece of leather, synthetic leather, or fabric material.

16. A method of securing an athletic grip to a user's hand, the method comprising:

positioning a pad on the user's palm, comprising positioning a medial cutout of the pad near the user's thumb and positioning a lateral extension of the pad near the user's small finger;

inserting a plurality of the user's fingers through a plurality of corresponding finger holes in the pad such that the tips of the user's fingers extend beyond the pad;

securing a belt having a buckle around the user's wrist; and positioning a wrist strap beneath the buckle such that a free end of the wrist strap extends laterally beyond the buckle and the wrist strap is positioned between the buckle and the user's skin and the belt and the user's skin and the wrist strap prevents the buckle from directly contacting the user's skin, wherein an outer-most portion of the lateral extension of the pad is closer to the wrist strap than an inner-most portion of the medial cutout of the pad.

17. The method of claim 16, wherein securing the belt around the user's wrist comprises:

looping a second end of the belt through the buckle; and removably coupling the second end of the belt to a first end of the belt.

* * * * *